United States Patent [19]

Source

[11] Patent Number: 4,629,010

[45] Date of Patent: Dec. 16, 1986

[54] PROCESS AND DEVICE FOR SINKING WELLS

[76] Inventor: Claude Source, 38 Avenue de Beaumont, 60 260 Lamorlaye, France

[21] Appl. No.: 737,440

[22] Filed: May 24, 1985

[30] Foreign Application Priority Data

May 29, 1984 [FR] France ..... 84 08382
Mar. 20, 1985 [FR] France ..... 85 04126

[51] Int. Cl.[4] ..... E21B 7/00

[52] U.S. Cl. ..... 175/57; 175/91; 175/96

[58] Field of Search ..... 175/57, 61, 65, 89–92, 175/94, 104, 106–108, 122, 263, 265; 299/36, 39, 78; 405/133

[56] References Cited

U.S. PATENT DOCUMENTS 1,461,713 7/1923 Gilman et al. ..... 175/96
3,770,067 11/1973 Ikeda ..... 175/96
3,894,587 7/1975 Source ..... 175/91

FOREIGN PATENT DOCUMENTS 665275 10/1965 Belgium ..... 175/263

*Primary Examiner*—James A. Leppink
*Assistant Examiner*—Thuy M. Bui
*Attorney, Agent, or Firm*—Larson & Taylor

[57] ABSTRACT

A device and process for sinking vertical wells. A pair of rotary digging heads have horizontal axes mounted on supports for movement of such axes towards and away from each other between a central position close to the axis of a well and a peripheral position adjoining the wall of the well being formed. The different heads are spaced apart so that the horizontal components of the reactions resulting from them cancel each other out. A process for using the device to form a well wherein the heads are initially close together and progressively move apart as the well is formed.

15 Claims, 10 Drawing Figures

Fig:7
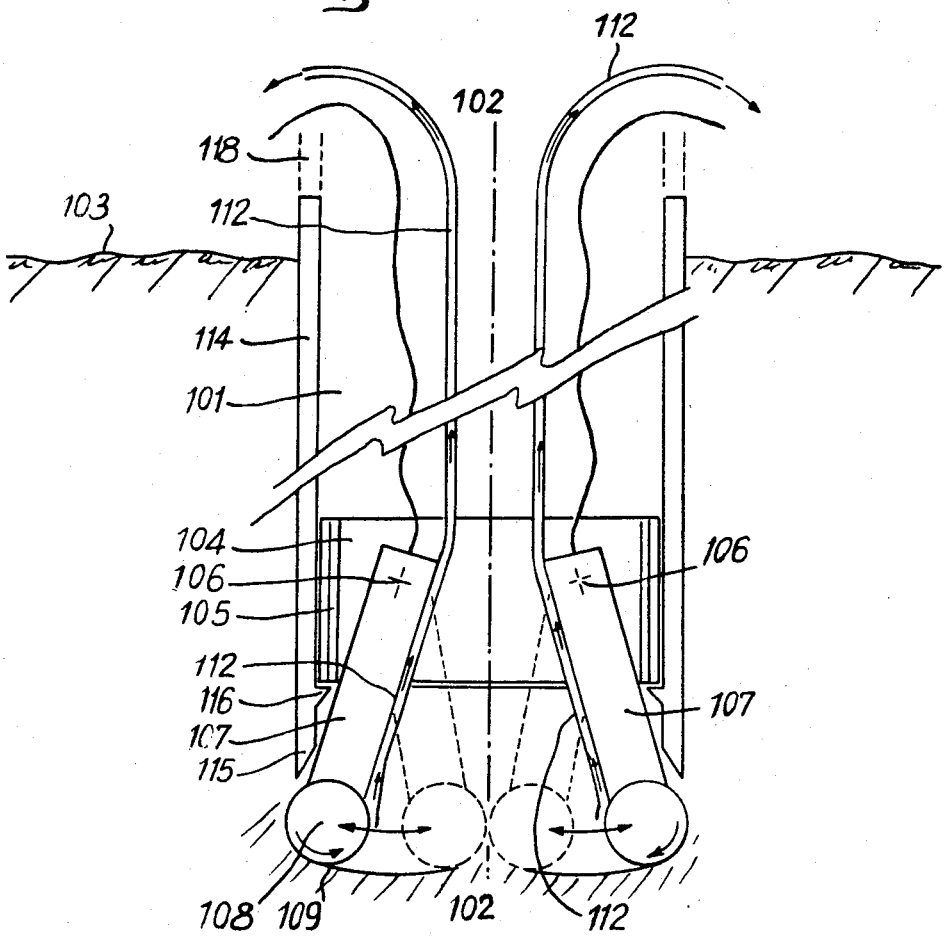
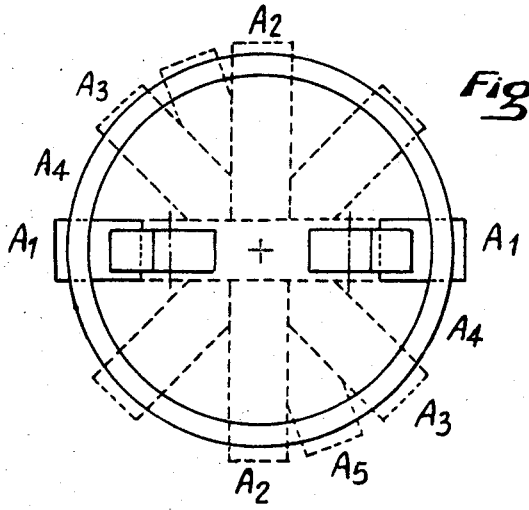
Fig: 8

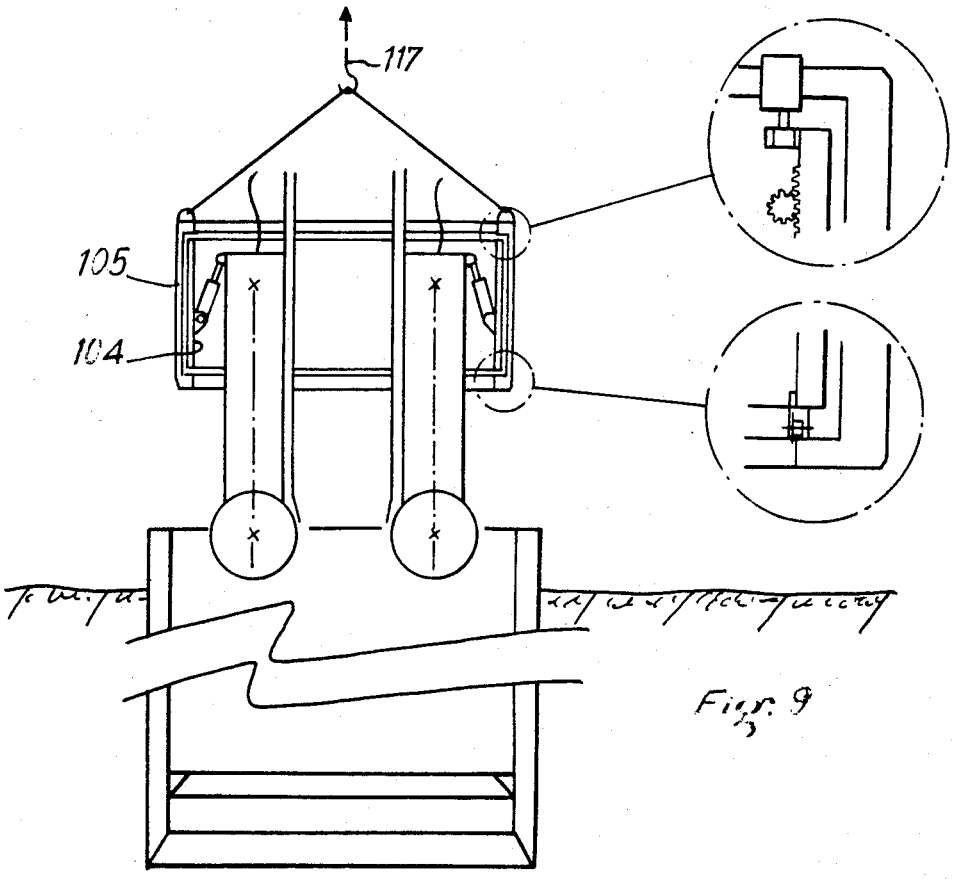
Fig. 9
Fig. 10
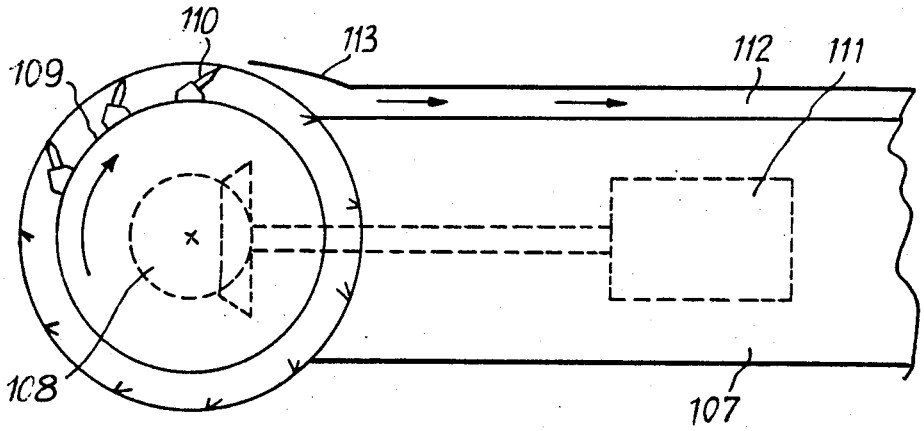

PROCESS AND DEVICE FOR SINKING WELLS

BACKGROUND OF THE INVENTION

1. Field of the Invention

The present invention relates to a device for sinking wells, applicable more particularly to sinking wells under conditions where the well is partially or totally filled with water during its sinking. The invention also provides a well sinking process using this device.

2. Description of the Prior Art

There already exist a number of devices for sinking vertical wells in different types of ground. Thus, a device is known for example described in U.S. Pat. No. 3 894 587 filed on the Dec. 7, 1973. This device comprises two rotary cutting heads rotating about two parallel axes in opposite directions so as to bring the spoil or excavated earth between the two heads, where it is sucked up into a discharge duct. Such devices, which are currently used, do not however allow a well to be sunk with simultaneous lowering of a casing. Furthermore, they are not practical for forming wells of any or varying lengths. In particular, with such devices it is also impossible to provide variations and in particular increases in length at the bottom of the well or at a certain distance between the bottom and the surface.

There exist also a number of devices which have a certain degree of automation and a certain performance level but they require the use of very high power, require very heavy and space consuming equipment and require the sinking operations to be stopped during the positioning of a casing element at the head of the well, so that, for wells of large dimensions or diameters, the sinking rates which may be reached are scarcely of the order of 1 meter per day.

SUMMARY OF THE INVENTION

The present invention proposes overcoming these drawbacks and provides a process and a device for sinking wells which allow wells to be sunk with any rectangular or circular section or a variable section while substantially increasing the sinking rate for wells of large dimensions while considerably reducing the weight and the space required for the equipment and, thus, the investment costs.

Another object of the invention is to provide such a device which allows the construction of a casing at the surface without interrupting the sinking during the construction of the casing.

Another object of the invention is to provide such a device which allows work to be carried out in wells which are inundated or under water.

Another object of the invention is to provide such a device capable of being used in all kinds of ground.

Another object of the invention is to provide such a device which may be automated.

Yet another object of the invention is to provide such a device which is economic and easy to use.

The invention provides then a device for sinking vertical wells comprising, on an assembly, at least one pair of rotary cutting heads whose axes of rotation are substantially horizontal, said heads being mounted on respective supports, preferably such as pivoting arms mounted on said assembly for movement, each time in a vertical plane and symmetrically, between a central position close to the axis of the well and a peripheral position adjoining the wall of the well being formed, and means for raising and lowering the cutting heads, the different heads being spaced apart so that the horizontal components of the reactions produced by their work cancel each other out reciprocally.

Advantageously, the supports for the heads are preferably pivoting arms mounted on said assembly each supporting a tool or head at its lower end, each arm of the pair being pivotably mounted by its upper end to a horizontal axis of the assembly, means, such for example as hydraulic cylinders, causing the arm to pivot about the axis between the folded up position in which the two heads of the pair are disposed close to one another and the spaced apart position in which the arms are slanted to a maximum away from the first position.

Preferably, each arm comprises a drive means, such as an electric motor or similar, for rotating its heads, so as to avoid movement transmission means. Also, with each head is preferably associated a spoil discharge means such as a spoil suction duct, the device thus comprising, at least in the lower part, two ducts for each pair of rotating heads.

Thus, the heads can be operated each time in a vertical movement plane, which, with only a vertical movement of the device, allows rectangular wells to be sunk whose width is equal to the cutting width of the rotary heads and whose length is at least equal to the sinking length of the pair of heads when they are in the closely spaced position, i.e. about two head diameters, and at most equal to the sinking length when the two heads of a pair are in the maximum spaced apart position.

In a variant of the process of the invention, rectangular wells can be sunk whose width may vary, at any depth, depending on the degree of spacing between the heads provided at the level considered. Thus, for example, wells can be sunk having an upper part longer than the lower part or a lower part longer than the upper part or an intermediate part longer or shorter than the upper and lower parts.

In an improvement ot the process, wells may also be sunk having a generally rectangular section or formed by the juxtaposition of several rectangles.

In accordance with this improvement, wells may also be sunk by sinking a rectangular casing, wherein the width of the casing is greater than the width of the heads and the length of the casing is greater than the length of the heads when they are brought close together, i.e. greater than a double head diameter, and less than the maximum possible well length.

Preferably, in such a shaft sinking process, the bottom is dug out first of all for example in a median part without going as far as the two ends so as to leave two lengthwise portions for supporting the casing, after which the earth is dug out on each side of the central dug out portion, including under the casing so as to finally bring the device into a central position and simultaneously dig out the two remaining parts, which support the casing, as far as under the casing, a means for detecting descent of the casing, sensitive to the movement of this latter, then controlling the immediate withdrawal of the heads from the spaced apart position to the closely spaced position.

According to an improvement of the invention, the heads are mounted on an assembly capable of rotating about the axis of the well, on respective supports, preferably pivoting arms mounted on said assembly, for movement, each time in a radial plane, between a central position close to the axis of the well and a peripheral position adjoining the wall of the well being formed, means for raising and lowering the cutting heads, and means for rotating said assembly so as to change the radial plane of movement, the different heads being spaced apart about the axis of the well so that the horizontal components of the reactions produced by their work cancel each other out reciprocally.

Preferably, the rotary assembly is mounted on a fixed support adapted for being locked against rotation with respect to the wall of the well or a casing.

Thus the heads may be caused to operate each time in a radial movement plane, then, after raising the heads, change the radial plane until the whole surface at the bottom of the well has been worked, the simultaneous movement of the heads during their working in their respective radial planes overcoming or minimizing the reactions which would tend to offcenter the device, which may then be relatively light and operate with reduced power.

In a preferred embodiment of the invention, the shaft sinking device is associated with a simultaneously advancing casing, and the cutting heads, in their peripheral position, operate under the cutting curb of the casing and retract inwardly when the casing begins to descend. Preferably, the support for the mobile assembly is supported by the lower element of the casing, having for example for this purpose an internal flange or rib.

The heads are disposed on supports such as arms, mounted at one end of the arm, the other end of the arm being mounted, preferably by means of a pivoting articulation, on the mobile assembly, means being further provided for raising the arm with its head either in the mobile assembly, or by raising the mobile assembly itself.

Drive means are also provided for ensuring the radial movement of the heads, for example by pivoting of the arms, these means being for example hydraulic cylinders.

Finally, the device advantageously comprises means for rotating the mobile assembly, these means consisting for example of hydraulic cylinders or a drive rack assembly. Preferably, the mobile assembly is adapted so as not to be able to rotate through a complete revolution but to move in rotation through a certain angle on each side of an initial position. Thus, in the case of a device with only two heads, the amplitude of rotation allowed for the assembly may be limited to 90° on each side of a central position.

Advantageously, the device of the invention may comprise means for detecting the downward movement of a casing and, as soon as the downward movement begins, causing the arms which support the heads to swing inwardly to leave the field free for the cutting curb of the casing.

Advantageously, the spoil discharge ducts, at the level of their respective heads, open at the rear part of these heads, that is to say at the part closest to the central axis of the well, for recovering the spoil which is brought to this position by the cutting head.

The device of the invention may be used for sinking all vertical wells for varied uses, such for example as mine shafts, storage wells, as well as for foundation excavations, for example bridge pile foundations at sea or in a river, quay wall foundations etc.

The invention also provides a process for sinking wells, in particular inundated wells, wherein, using at least two cutting heads disposed about the axis of the well so that the horizontal components of the reactions produced by their working cancel each other out reciprocally, trenches are dug out in the bottom of the well by simultaneous movement of the heads in their radial planes between a first central position and a second peripheral position, the heads are raised and are brought by rotation about the axis of the well into second radial planes for digging out new trenches and so on.

In the preferred case of sinking a casing well, the casing is lowered simultaneously and the heads are brought into their peripheral positions under the cutting curb of the casing, the downward movement of the casing is detected and, in the case of a downward movement, the heads are freed from the cutting curb.

BRIEF DESCRIPTION OF THE DRAWINGS

Other advantages and features of the invention will appear from reading the following description given by way of non limitative example with reference to the accompanying drawings in which:

FIG. 7 shows a schematical sectional view of a device in accordance with the invention;

FIG. 8 shows a schematical top view of the device;

FIG. 9 shows a schematical view in axial section of the device during the lifting operation; and FIG. 10 shows a schematical view of a cutting head with its arm.

DESCRIPTION OF THE PREFERRED EMBODIMENTS

Figure 1:
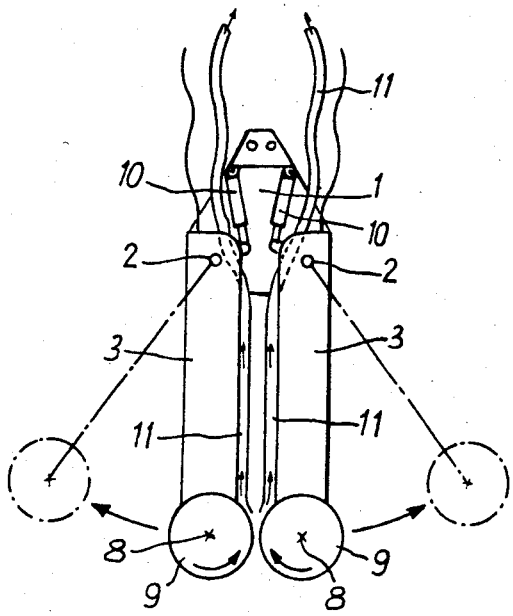
FIG. 1 shows a schematical elevational view of a device of the invention.

The device shown comprises an assembly 1 suspended by its upper end from cables, chains or other connections not shown and which allows the device to be lowered and raised from means disposed at the well head surface and comprising one or more suitable winches.

On head 1 are mounted for pivoting about axes 2 two arms 3 having for example the form of elongate and flattened caissons and having at their lower ends a horizontal shaft 8 about which a cutting head 9 may rotate formed by a drum on the periphery of which are mounted conventional picks 9*a*. The number of picks, the arrangement and slope thereof with respect to the cylindrical surface of the drum 9 may be determined by a man skilled in the art from his knowledge in earth digging matters.

By way of example, reference may be made to the picks shown in the U.S. Pat. No. 3,894,587. The heads 9 are rotated, either directly by electric motors fixed to shaft 8, or by means of pinions and drive shafts, the whole of the transmission then being contained in the corresponding arm 3.

The arms 3 may be pivoted in the same vertical plane symmetrically with respect to each other, from the central position shown with a continuous line in FIG. 1 towards an endmost peripheral position shown with a dash dot line in this same Figure and vice versa, under the action of hydraulic cylinders 10 supported by assembly 1. Considering the direction of rotation of heads 9 about their shaft 8, shown by the corresponding arrows, the cutting operations take place from the central position shown with a continuous line to the peripheral position shown with a dash dot line.

At the rear and along the arms is situated a duct or conduit 11 which reaches the vicinity of the cutting head 9 where it has a deflector disposed so that the flow of liquid, which rises through duct 11 under the effect of pumping means (not shown), removes the spoil coming from the working of heads 9.

Assembly 1 may further comprise means (not shown) allowing it to be temporarily fixed to a casing, these means being possibly for example shoes which extend transversally from the assembly for application against the internal face of the casing and which may be retracted when it is desired to separate the device from the casing.

Figure 2:
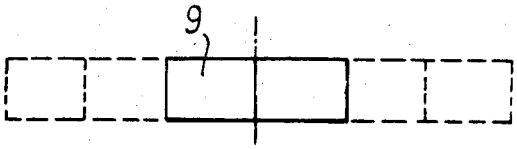
FIG. 2 shows a schematical top view of the two heads of the pair of heads, the rest of the device being omitted.
Figure 3:
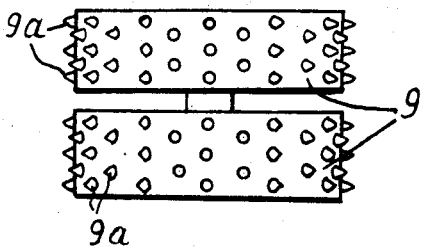
FIG. 3 shows schematically a cutting head removed, seen from the top.

The operation is as follows:

From the position shown in FIG. 1 in which heads 9 rest at the bottom of the well, the heads are rotated in the directions of the arrows while sucking up the spoil. The heads dig into the soil and then the cylinders 10 are actuated so as to progressively move the two arms away from each other, thus causing the formation of a trench whose width is substantially equal to the width of heads 9 and whose length is equal to twice the diameter of heads 9 if the heads remain close together and greater than twice the diameter if the heads are moved apart, the extreme length being, for example in the case of the device shown in FIG. 1, about 6 times the diameter of head 9. In FIG. 2 can be seen the different positions of heads 9 seen from the top, the assembly forming the trace of this trench.

Once the heads have been brought to their endmost position, the heads are brought back towards the center and a new pass is proceeded with for digging out a new trench and so on until a rectangular well of the desired depth is obtained. During this work, the reaction forces which are produced by the two heads 9 balance each other out so that no substantial force tending to deviate the device exists.

The device described may work in dry wells with air suction for removing the spoil, but may also, advantageously, work in wells under water.

Figure 4:
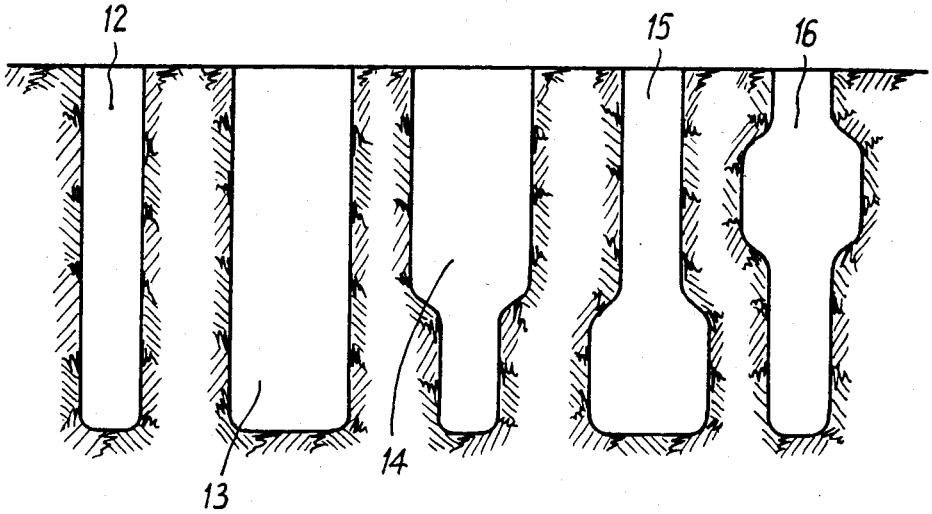
FIG. 4 shows a schematical view of different forms of wells able to be sunk by means of the invention.

In FIG. 4 have been shown schematically wells in the direction of the length, the depth of the wells being of course of any length.

Well 12 corresponds to a well of minimum length of 2 diameters of head 9, as shown in FIG. 2.

FIG. 4 shows at 13 a well of maximum length, as shown with a broken line in FIG. 2.

Well 14 has an upper part of the same length as well 13 and a lower part of the same reduced length as well 12.

Well 15 has an upper part of small length and a lower part forming a widening of great length.

Well 16 has an intermediate widening of great length.

Figure 5:
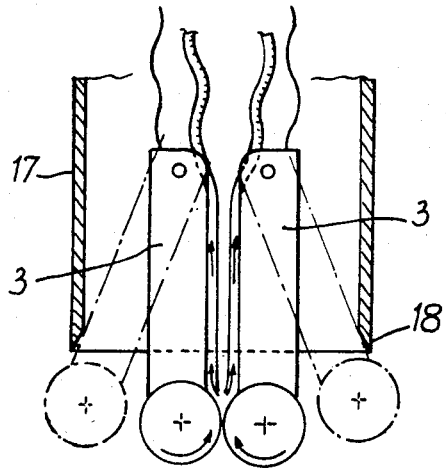
FIG. 5 shows a schematical elevational view of the device during cutting of a well with casing.
Figure 6:
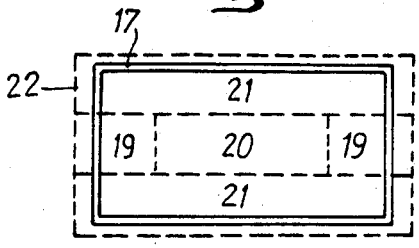
FIG. 6 shows a schematical top view of this well during sinking.

Reference will now be made to FIGS. 5 and 6.

The internal wall of the well is covered by a rectangular shaped casing 17 whose lower element has, over the whole periphery of the rectangle, a conventional cutting curb or edge 18. The operation is as follows:

At the beginning of a pass, the casing is supported by its lower part on two unexcavated lateral portions 19. On the other hand, the central portion 20 extending between the two support portions 19 and having the width of head 9 has been dug out, as well as the two lateral portions 21 which are dug out over the whole of their length. 22 shows the wall of the well.

From this moment, zones 20 and 21 are excavated so that the height of the unexcavated portions 19 becomes greater than twice the diameter of head 9. For that, zone 20 is excavated while keeping the two arms 3 close together, as shown in the full line position in FIG. 5. Portions 21 are excavated after movement in the widthwise direction of the assembly, digging taking place from the central closed up position to the spaced apart position shown with a dash dot line in FIG. 5. After that, the assembly is brought back to the central position, with the arms brought close together, i.e. in zone 20, the assembly is moved upwardly and then the arms are moved apart for excavating portions 19, which are excavated but only over a height of about 1 diameter, in the position of the heads shown in FIG. 5. At a certain moment, the cutting curb 18 is no longer supported and the casing 17 begins to descend. This movement is instantaneously detected by suitable detection means, which causes an immediate withdrawal to the central position shown with a continuous line in FIG. 5. The casing descends and is stopped by the rest of portion 19 which has not been excavated, after which the assembly is lowered for again excavating portion 20 then portions 21 and so on.

During digging, the spoil is sucked up by ducts 11.

It will be readily understood that shaft sinking continues without interruption, removal of the spoil not taking any more time. The upper edge of casing 7 is of couse freely accessible since the lifting means may be adapted for standing on the ground and completely freeing the upper edge of the casing. The casing may therefore be extended at its upper part progressively as it is lowered.

In the foregoing it will be understood that by depth is meant the vertical dimension of the well, by length the largest horizontal dimension (sometimes called width in technical language, and by width the second horizontal dimension (sometimes called thickness in technical language).

Of course the invention has been described in connection with a particular embodiment, but of course it is not limited thereto and different modifications may be made without departing from the scope or spirit of the invention.

Thus, the device of the invention may be used for forming, in an improved fashion, concreted walls, that is to say reinforced walls cast in the ground and which comprise primary elements or panels separated by spaces of ground forming a shuttering for the adjacent ends of two consecutive panels. Usually, these spaces which will be excavated for casting the secondary panel interposed between two primary panels, have a length a little less than two drum head diameters so that the tools may bite into the concrete of the two adjacent ends of the primary panels, ensuring good sealing after concreting.

In accordance with the invention, spaces of a greater length may be provided, for example of about 6 drum diameters, which are excavated by biting into the concrete of the larger dimension secondary panels and the number of joints may be reduced. Preferably, the space is first of all excavated then the concrete bitten into during raising of the device.

Reference will now be made to FIGS. 7 to 10. The device shown is intended for sinking a vertical inundated well 101, having access 102 from the surface 103. Preferably, the diameter of the well may be of the order of 3 meters, up to 12 to 15 meters.

The device comprises a mobile assembly 104, having for example a cylindrical shape and intended for rotation about axis 102 inside a fixed support 105 on which the assembly 104 rests by means of a suitable circular rolling track (not shown).

Inside the mobile assembly and about 2 pivoting shafts 106 carried by a slide guided vertically in assembly 104, may pivot two arms 107 having for example the form of elongate caissons and comprising at their lower end a horizontal shaft 108 parallel to the rotation shafts of arms 107 and 109 about which may rotate a digging head formed from a drum on the periphery of which are mounted conventional picks 110. The number of picks, the arrangement and slope thereof with respect to the cylindrical surface of the drum may be determined by a man skilled in the art from his knowledge in ground digging matters. The heads 109 are driven through pinions and drive shafts shown schematically in FIG. 10, by means of an electric motor 111, the assembly of the motor and the transmission being contained in the corresponding arm 107. The arms 107 may be pivoted in the same vertical and diametrical plane, from a central position shown with a broken line in FIG. 7 to a peripheral position shown with a continuous line in this same Figure and vice versa, under the action of hydraulic cylinders (not shown) supported by the mobile assembly 104. Considering the direction of rotation of heads 109, shown by the arrow in FIG. 7, the digging work is effected from the central position shown with a broken line towards the peripheral position shown with a continuous line.

At the rear and along arms 107 is disposed a duct or conduit 112 which reaches the vicinity of the digging head 109 where it comprises a deflector 113 disposed so that the liquid flow, which rises through conduit 112 under the effect of pumping means (not shown), takes with it the spoil coming from the working of heads 109.

The internal wall of the well is covered by a casing 114 whose lower element has a conventional cutting curb 115. The lower casing element, further has, inwardly, one or more internal flanges 116 on which the fixed support 105 rests.

Support 105 may be raised by lifting means 117 for lowering the device into the well and for raising it again.

Support 105 also comprises means (not shown) for interlocking it with the casing, after being brought into the position shown in FIG. 7 at the bottom of the well during sinking, so as to prevent it from rotating on its support rib 116. These means may for example be shoes which extend radially for application against the internal face of the casing and which may be retracted when it is desired to raise the support 105.

The operation is as follows:

At the beginning of a pass, the rotary assembly 104 is interlocked for rotation with the support 105 and cannot rotate with respect to this latter. The two arms 107 are in the position shown with a broken line in FIG. 7, the digging heads being then in a central position. The motors 111 are started up so that the digging heads 109 begin to excavate the bottom of the well and, simultaneously, the two arms 107 move apart with a symmetrical movement, still in the same starting diametrical plane A1—A1 which can be seen in FIG. 8. When they have reached their peripheral position in plane A1—A1, in which position they are disposed under the cutting curb 115 of the casing, the heads 109 have excavated a diametrical trench shown with a broken line in FIG. 8 and having the vertical plane A1—A1 as plane of symmetry.

Meanwhile, the spoil has been sucked up into ducts 112 and raised to the surface for removal. Once the peripheral position has been reached, the rotational movement of the heads 109 is stopped and arms 107 are raised inside the mobile assembly 104 at the same time as the arms are swung towards axis 102 for disengaging the heads from under the cutting curb. At this moment, assembly 104 is set in rotation, for example through 90°. The arms are then lowered again and the same cycle begins, this time in thc plane A2—A2. The heads thus excavate a new trench perpendicular to the first one. Once these two trenches have been excavated, the same operations begin again and the mobile assembly is brought to another intermediate angular position A3—A3, between positions A1—A1 and A2—A2, and thus in as many positions as is required for working the whole of the surface of the bottom of the well.

When the essential part of the surface at the bottom of the well has been excavated, in general towards the end of the last pass corresponding to the last angular position, for example A5—A5, the casing which is no longer retained by the earth begins to slide downwards. A suitable detector disposed on the surface, for example, detects the beginning of this sliding and then causes the arms 107 to swing immediately towards axis 102 and preferably causes the arms to be raised simultaneously so as to prevent the cutting curb from coming into contact with heads 109.

The number of passes at a given level, i.e. the number of vertical planes A1—A1 . . . A5—A5, depends of course on the diameter of the well and on the width of the cutting heads 109.

It will moreover be understood that shaft sinking continues without any interruption, removal of the spoil not taking any more time, contrary to what happens when the spoil has to be raised by winching, because the raising length increases with the depth of the well.

The edge of casing 114 is obviously freely accessible since the lifting means may be adapted for standing on the ground 103 and completely freeing the upper edge of the casing. So the casing may be extended continuously at 118 at its upper part progressively as it is lowered, either by positioning prefabricated concrete or metal elements, in the form for example of two half shells, or by casting the concrete casing.

Because practically no reaction is met with tending to rotate the mobile assembly 104 in its support 105, the device of the invention may be very light and, by means of a device weighing in all about 5 tons, wells may be sunk having a diameter of 3 to 5 meters at a speed of the order of 1 meter per hour, because the sinking of the well, the removal of the spoil and heightening of the casing are carried out simultaneously without using operators at the bottom of the shaft.

Although the invention has been described in connection with a particular embodiment, it is of course in no wise limited thereto and different modifications of form or materials may be made thereto without for all that departing from the scope and spirit of the invention.

What is claimed is:

1. A device for sinking vertical wells, comprising, on an assembly, at least one pair of rotary digging heads whose axes of rotation are substantially horizontal, said heads being mounted on respective supports mounted on said assembly for movement, each time in a vertical plane and symmetrically, between a central position close to the axis of the well and a peripheral position adjoining the wall of the well being formed, and means for raising and lowering the digging heads, the different heads being spaced apart so that the horizontal components of the reactions produced by their work cancel each other out reciprocally.

2. The device as claimed in claim 1, wherein said assembly is adapted for rotating about the axis of the well, so that the digging heads may be moved each time in a radial plane between a central position close to the axis of the well and a peripheral position adjoining the wall of the well being formed, with means for raising and lowering said digging heads and means for causing said assembly to rotate so as to change the radial plane of movement, the different heads being spaced apart about the axis of the well so that the horizontal components of the reactions produced by their work cancel each other out reciprocally.

3. The device as claimed in claim 2, wherein said rotary assembly is mounted on a fixed support able to be locked against rotation with respect to the wall or to a casing of the well.

4. The device as claimed in claim 3, wherein said fixed support is adapted so as to be interlocked with the lower part of a casing, in a position allowing said heads to work under the cutting curb of the casing.

5. The device as claimed in claim 1, wherein said heads are fixed to the end of arms mounted for pivoting on the mobile assembly about axes parallel to the axes of the heads under the action of drive means.

6. The device as claimed in claim 5, wherein said arms comprise drive means for the heads.

7. The device as claimed in claim 1, wherein with each head is associated a duct or conduit for removing the spoil.

8. The device as claimed in claim 1, further comprising means for detecting the downward movement of a casing for controlling a movement disengaging the heads from under the cutting curb of the casing.

9. The device as claimed in claim 1, wherein the supports of said heads are arms supporting their head at one end and having their other end pivotably mounted on a piece or slide adapted for vertical movement in said assembly.

10. A process for sinking wells including providing a device having at least one pair of rotary digging heads whose axes of rotation are substantially horizontal and which are mounted on respective supports on an assembly for movement symmetrically in a vertical plane between a central position close to the axis of the well and a peripheral position adjoining the walls of the well, including providing means for raising and lowering the digging heads, wherein the digging heads are spaced apart so that the horizontal components of the reactions produced by their work cancel each other out reciprocally, and forming at least one trench starting from the position in which the heads are close together and progressively moving the heads apart symmetrically with respect to each other, the well being formed by digging out successive trenches.

11. The process as claimed in claim 10, wherein the spacing between the heads, and so the length of the well, is varied so as to obtain wells of variable length.

12. The process as claimed in claim 10, for forming a well by sinking a shaft with a rectangular casing in which the width of the casing is greater than the width of the heads and the length of the casing is greater than the length of the heads when they are in the closely spaced position, wherein zones are excavated including under the casing, while leaving two unexcavated zones for supporting the casing, then said zones are excavated simultaneously until the casing starts to move down, then the downward movement of the casing is detected and the heads are immediately brought back towards each other away from the casing.

13. The process as claimed in claim 10, wherein a well is sunk between the ends of two primary concreted wall panels while biting into the concrete of said ends.

14. A process for sinking wells, including providing a device having at least one pair of rotary digging heads whose axes of rotation are substantially horizontal and which are mounted on respective supports on an assembly for movement symmetrically in a vertical plane between a central position adjoining the walls of the well, and including providing means for raising and lowering the digging heads, wherein the digging heads are spaced apart so that the horizontal components of the reactions produced by their work cancel each other out reciprocally, wherein the assembly rotates about an axis of the well so that the digging heads may be moved in a radial plane between a central position close to the axis of the well and a peripheral position adjoining the walls of the well, and wherein the device has a means for raising and lowering the digging heads and a means for causing the assembly to rotate to change its radial plane of movement, using at least two digging heads disposed about the axis of the well so that the horizontal components of the reactions produced by their work cancel each other out reciprocally, excavating trenches in the bottom of the well by simultaneous movement of the heads in their radial planes between a first central position and a second peripheral position, and then raising and bringing the heads by rotation about the axis of the well into second radial planes for excavating new trenches and so on.

15. The process as claimed in claim 14, wherein a casing is lowered simultaneously and the heads are brought into their peripheral positions under the cutting curb of the casing, the downward movement of the casing is detected and in the case of the downward movement the heads are disengaged from under then cutting curb.

* * * * *